US005502951A

United States Patent [19]

Oliverio et al.

[11] Patent Number: 5,502,951

[45] Date of Patent: Apr. 2, 1996

[54] CONVERTIBLE PITCH POUCH MACHINE

[75] Inventors: Frank G. Oliverio; Boris E. Makutonin, both of Cincinnati, Ohio

[73] Assignee: R. A. Jones & Co. Inc., Covington, Ky.

[21] Appl. No.: 338,860

[22] Filed: Nov. 14, 1994

[51] Int. Cl.[6] ..... B65B 43/04; B65B 3/02

[52] U.S. Cl. ..... 53/455; 53/562; 53/201; 53/284.7; 493/197; 493/198; 493/205; 493/208

[58] Field of Search ..... 53/455, 479, 469, 53/284.7, 562, 570, 374.4, 374.5, 201; 156/498, 529, 581, 582, 583.1; 493/191, 193, 197, 198, 205, 208

[56] References Cited

U.S. PATENT DOCUMENTS

| | | | |
|---|---|---|---|
| 3,344,576 | 10/1967 | Cloud et al. | 53/455 |
| 3,453,799 | 7/1969 | Cloud et al. | 53/455 |
| 3,478,492 | 11/1969 | Cloud et al. | 53/284.7 |
| 3,563,001 | 2/1971 | Cloud et al. | 53/284.7 X |
| 3,597,898 | 8/1971 | Cloud . | |
| 3,791,267 | 2/1974 | Brooks | 493/198 X |
| 3,821,873 | 7/1974 | Benner, Jr. et al. . | |
| 3,822,008 | 7/1974 | Benner, Jr. et al. . | |
| 3,908,979 | 9/1975 | Cloud et al. . | |
| 3,961,697 | 6/1976 | Hartman et al. . | |
| 4,232,504 | 11/1980 | Dieterlen et al. . | |
| 4,316,566 | 2/1982 | Arleth et al. . | |
| 4,344,269 | 8/1982 | Dieterlen et al. | 53/455 X |
| 4,702,289 | 10/1987 | Benner, Jr. et al. . | |
| 4,848,421 | 7/1989 | Froese et al. . | |
| 4,872,382 | 10/1989 | Benner, Jr. et al. . | |
| 5,220,993 | 6/1993 | Scarpa et al. . | |
| 5,222,422 | 6/1993 | Benner, Jr. et al. . | |
| 5,320,146 | 6/1994 | Stevie . | |

*Primary Examiner*—Horace M. Culver
*Attorney, Agent, or Firm*—Wood, Herron & Evans

[57] ABSTRACT

Methods of converting pitch on a pouch machine include using a standard drive table with above table change parts including sealer wheel, filler wheel and knife. The sealer wheels and filler wheels are retained at respectively the same diameters to facilitate use of the common drive and to facilitate maintenance of the pouch web path through the machine for all pouch pitch ranges. Pouch stations on the sealer and filler wheels are not limited to whole degree movements and pouch web speeds are preferably maintained constantly for all pouch pitch ranges.

19 Claims, 8 Drawing Sheets

CONVERTIBLE PITCH POUCH MACHINE

BACKGROUND OF THE INVENTION

This invention relates to high speed pouch forming, filling and sealing and more particularly to convertible pouch filling and sealing methods for accommodating pouches of varied widths or pitch at speeds in excess of about 300 to 400 pouches per minute.

This application is related to applicant's copending applications as follows: "Convertible Pitch Pouch Knife", naming Paul E. Dieterlen as inventor; "Variable Count Direct Deposit Knife" by Paul E. Dieterlen; "Tuck Roller With Improved Web Tension Control", naming Martin Wildmoser and Frank Oliverio as inventors; and "Low Thermal Inertia Sealer", naming Martin Wildmoser as inventor, all filed on even date herewith and expressly incorporated herein by reference.

Current high speed pouch machines are capable of filling and sealing pouches at commercial speeds of, for example, two to four million pouches per week, based on single shift operation. While such machines represent a highly advanced stage of operational speeds, such machines are limited by tack of flexibility in pouch width or pitch (i.e. cut-off). While current high speed horizontal form fill and seal machines can easily deal with taller or shorter pouch changeovers, such as pouches from one inch to twelve inches tall, such machines are not easily convertible to changes in pitch at desirable commercial speeds.

Currently, a commercial pouch forming, filling and sealing machine is dedicated to one pouch width or pitch, with only slight available adjustment. Such a machine may cost in the range of something over $500,000 up to something less than $1,200,000. Purchasers or end users of such machines are thus constrained, by virtue of such capital investments, to certain pouch widths or pitch, with only minor variations, for significant periods of time.

While manufacturers might provide machine pitch conversion, this process generally has required a long and involved rebuild of the machine, taking at least four to six months and costing in the neighborhood, for example, of $300,000 to $400,000. This conversion would then be dedicated to the converted pitch.

Product marketers desire to be able to offer products in varied size (i.e. varied width) pouches. Future changes in market packaging configuration can quickly obsolete a given pouch width, and thus the associated dedicated width machine. Machines dedicated to given pouch widths preclude attempts to run special trial sizes or promotional pouches.

It will be appreciated then that dedication to a given pouch width generally requires the customization of each original pouch machine to such width. This, however, renders each machine more or less one of a kind, limiting its practical convertibility. For example, a pouch machine typically includes a web plow for folding a moving web onto itself, a vertical sealer, designed and dedicated to a given pitch, for creating vertical seals in the moving, folded web, a pouch filler wheel designed and dedicated to the selected pouch width or top sealer for opening and filling pouches between the seals, and a knife also designed and dedicated to the design pouch widths for cutting sealed pouches off the web train. One or more feed augers are used to introduce product into pouch filling spouts and into the pouches themselves.

A web of pouch material is thus typically folded on itself and sealed vertically to form given pitch, open ended pouches. These are filled, top sealed, and individual pouches are cut off from the pouch train by the knife, slicing down through the vertical seals. These various components have to be coordinated for speed consistency as each operates on the moving, unbroken pouch train.

Thus, the typical previous approach to pouch machines required that each machine be unique and custom built, designed and dedicated to a given pouch pitch. Even though the outward appearance from one machine to another often looked the same, the drive transmission, drive element positions and drive ratios were quite different, depending on the design pouch width. Due to this uniqueness, conversions to alternate pouch widths were difficult and expensive.

A brief explanation of several of the machine components will help provide further understanding of the pouch pitch conversion difficulties faced in the past.

A) Filler Wheel Stations:

The filler wheel carries a quantity (20 to 50, for example) of vertical vacuum lands that hold the pouch in position by its side vertical seals during the filling process. Each station contains parts, such as these lands, and a pouch tucker to facilitate full bottom opening, that have to be located radially and very accurately to maintain proper opening of the web during the filling process.

Machine tool accuracy, for radially located slots and holes in larger diameter plates, historically were easier to attain for standard degree increments about the filler wheel. Indexing tooling, as well as many machine tool capabilities, required the standard degree increment. This precipitated the use of certain number of station filler wheels, each corresponding to a standard degree increment. The three significant filler wheel stations used on many prior machines were 36 station (each station at 10 degrees); 30 station (each station at 12 degrees); or 24 station (each station at 15 degrees). Generally, the standard degree increment was in the past based on whole degree increments. While some increments less than whole degree increments might have been standardized, such as to, for example, ½ or ¼ degree increments, nevertheless, an infinite range of increments outside these standards has not historically been available.

As the designs tended to gravitate toward filler wheels with those main three groupings of filler wheel stations, it perpetuated the need for custom design of each wheel. For example, the diameter of a 36 station filler wheel for a 4 inch pouch cutoff will vary considerably, from the diameter of a 36 station filler wheel for a 3 inch cutoff.

Thus, the diameter of the filler wheel for varied pouch widths would ordinarily vary. This geometric relationship would be of no real consequence except for one simple requirement of a typical machine and that is how and where the web of pouches exits the filler wheel. It is a fundamental requirement of the operation of the machine that the web pays off in a tangential orientation from the filler wheel and proceeds in a straight line toward the top sealing assembly and along the path of pouches through such top sealer. The variations of pouch heights and pouch weights make guiding the bandoleer of pouches in anything other than a straight line very difficult. The top sealer design also can tolerate very little side load, making straight tangency into the pouch sealing path even more of a requirement. Idler rollers or guide rollers that would attempt to guide a non-tangent web or non-aligned web after it comes off the filler wheel would compromise the stability of the bandoleer entering into the top sealer assembly. Accordingly, conversion to a different pitch in the past generally required a different diameter filler wheel. In order to maintain tangency of that new, different diameter wheel to the top sealer pouch path, the drive axis or the top sealer would have to be moved. This required major rebuild of the machine.

B) Drive Gearing

Another design element that tended to force the filler wheel to be tangent with the top sealers, and consequently the secondary feed rollers, was the use of a variable speed gearbox called the P.I.V. box for the top sealer. The box, due to its considerable size and method of drive, made relocation very difficult, and it was therefore difficult to move the top sealer to maintain its pouch path in alignment with, and tangent to, the take off point of the pouch train.

The dilemma that occurs from the tangency requirement and the need to stay with full degree increments on the filler wheel (e.g. 36 station) is then that the main centerline of the filler wheel must change with each variation in pouch width. Thus begins the need for a custom built drive. As the filler wheel changes in centerline position, many things begin to move with it. The main assemblies that change are the top plate—centerline of filler wheel bearing assembly and drive; tucking roll assembly and drive; and the feed auger position. All these changes, due to pouch pitch conversion, have historically required a machine rebuild.

C) Speed and Size of Filler Wheel and Vertical Sealer

The filler wheel and the vertical sealer for a typical pouch machine are time based processes. For the filler wheel, the driving elements are those variables which affect the falling of the product into the pouch spouts and into the pouches. For example, the spouts may be 6.5 inches tall. The amount of time that the pouch must remain on the filler wheel to achieve the complete fill process is a function of RPM, angle of drop, diameter of filler wheel, height of spouts and product settle time.

There are other product specification characteristics that affect filler wheel settle time. These include, for example, product density, fat content, angle of repose and the products' propensity to clump or bridge.

Experience with application becomes very important to apply those variables. Design of filler wheel sizing uses the most conservative (worst case) scenario to represent those products which take the longest to drop through the spouts into the pouch.

The filler wheel is modeled to accomplish the following process:

1. Tuck pouches onto filler wheel lands;
2. Blow pouches open;
3. Insert spout into pouches;
4. Begin filling—feed auger #1;
5. Begin filling—feed auger #2;
6. Theoretical drop after feed auger #2;
7. Settle time for loose particles to enter pouch (designed for worst case products);
8. Retract angle of spouts (where the spouts were rotated into the pouches by mounting the spouts on a wheel turning in a plane at an intercepting angle to the plane of movement of pouches about a filler wheel).

Many calculations thus go into an engineering model used for sizing the filler and which affect its size. In general, the factors approach models each of the above mentioned processes in terms of angle, at a given RPM, that translates to a time based process model for each function. These factors are all based on pouch pitch or width. These calculations are not pertinent here except to illustrate the circumstance that the design of pouch machines was heretofore a captive of or dependent on the pouch width. When considered with operational speed, such a design width or pitch has thus demanded customized size and spatial relationships between the components of the machine.

D) Vertical Sealer:

The vertical sealer considerations are in many ways analogous to those for the filler wheel. Both units are, in essence, multi-faceted polygons with standard side seal widths between each face of the polygon. Both are also time based processes in that the web must stay on each wheel for a certain minimum time to achieve each process. For the vertical sealer, it is a typical requirement that the web experience a seal time between 1.1 to 1.5 seconds.

If the seal time is less than 1.1 seconds, the probability of producing a bad seal greatly increases. It is not desirable to compensate for short seal times by increasing the vertical sealer temperature due to the problem that occurs when the machine stops. During that stoppage, the web that remains still on the vertical sealer wheel will experience side seal propagation. The higher the temperature of the vertical sealer lands, the greater propagation that occurs. As the seals propagate past 0.5 inches, those pouches on the vertical sealer must be scrapped. If the seals propagate past 0.750 inches, it may not be possible to restart the machine due to the fact that the pouches are now so narrow that spouts will not insert; web tearing or breakage may occur.

On the other hand, if the vertical seal times exceed 1.5 seconds, the number of stations and subsequently wheel diameter may increase to the point where it is both cost and geometrically prohibitive.

The sizing of the vertical sealer is thus constrained by the following combination of factors:

1. Seal times between 1.0–1.5 seconds.
2. Diameters that are not prohibitively large. The larger the wheel, the greater the number of stations. Generally, the diameter of the vertical sealer has been kept below 40 inches.
3. Sealer wheel wrap angles between 230°–270° . If the wrap angle is too large, the web will not slip around the vertical sealer which may be needed to keep the pouch print in register.
4. Maximum web speed or pouches/minute required to achieve the process.

It will be appreciated that within these confines, pouch pitch is an important design factor.

E) Vertical Sealer and Filler Wheel Together:

As it has been noted before, each of the two major processes, i.e. side sealing on the vertical sealer and filling on the filler wheel are time based processes. Even as the need for higher pouches per minute increases, the seal times and fill times remain constant. This production increase forces the diameters of the wheels to increase due to the above minimum dwell times of pouches on the wheels being constant and since the only way to increase pouches per minute speed is to increase the number of stations on both. As noted above,changing diameters, at least of the filler wheel, require different drive centers where web take off tangency must be maintained.

The second point that must be considered is that since the filler wheel and the vertical sealer are processing the same continuous registered web, the pouch rate entering and exiting the vertical sealer must exactly equal the pouch rate entering and exiting the filler wheel. The filler wheel and vertical sealer are driven by a certain ratio drive relationship, which is coordinated with the ratio of the number of pouch stations on the sealer with respect to the number of stations on the filler. This design parameter of having stations only on whole degree increments on both filler wheel and sealer wheel, together with the requirement for integrated corresponding drive ratios thus further limits the pitch conversion rate.

F) Impact of Custom Design of Other Stations:

The design which customizes the filler wheel and vertical sealer for a given pouch per minute speed forces drive relationships to change for other important stations within the machine, namely:

1. First feed rollers
2. Tucking roll
3. Code daters
4. Knife station.

Exact drive ratios that match the design web speed or attempt to register the pouch to a process (code dater and knife) all change with each pitch design. Significant engineering hours (300–500 hours) are required to re-configure the drive and frame for each custom machine.

SUMMARY OF PAST DESIGN FACTORS AND LIMITATIONS

In summary, the reconfiguration of a pouch machine from one pouch pitch to the other is a function of:

1. The fixed station approach to filler wheels (i.e. 36 station [10°]; 30 station [12°] or 24 station [15°]). The need for whole degree machining processes tended to force this approach.
2. Diameters of filler wheels and vertical sealers varied with pouch widths when the constant station number approach was used.
3. The web must pay off the filler wheel tangentially into second feed rollers and the top seal area.
4. The PIV gearbox orientation made alignment for tangency difficult to change for the top sealer and second feed roll zone.
5. The filler wheel and vertical sealer are both time based processes. The ability to complete each process is dependent on the amount of seal time or fill time that the web spends on each wheel.
6. As speed of the web increases and RPM remains constant (in order to complete the process) larger diameter wheels are needed to provide necessary process dwell times.
7. As the filler wheel axis is moved to different locations on the machine's top plate, the drive transmissions and the positions of the following are affected:
   a. first feed rolls;
   b. tucking rolls
   c. code daters
   d. knife stations While attempts have been made to provide high speed pouch machines that are convertible to varied pouch widths or pitch, none have accommodated the currently desired speed range such as that noted above, of about 4000 inches per minute (i.e., 1000 pouches/min @4" pouch width), for example, but only perhaps less than ⅓ of such speeds.

Accordingly, there has long been a need for a pouch filling and sealing machine operable at today's commercial production speeds, yet convertible to varied pouch widths running at the same pouch per minute speeds. Generally herein, the term "convertible" is used to refer to apparatus requiring changes in tooling or hardware to accommodate alternate pouch widths. This is to be contrasted to the concept of adjustability wherein designed-in machine adjustability provides for contrastingly very slight fine adjustments to pouch widths for such purposes, for example as accommodating slight seal width or registration changes due to varied product volume in the same pouches.

It is thus one objective of this invention to provide a convertible pouch filling and sealing machine operable at speeds currently provided by current high speed machines which are dedicated to a predetermined pouch width or pitch.

Another objective as been to provide improved methods for converting a pouch forming, filling and sealing machine to handle pouches of other pitch.

Another objective of the invention has been to provide methods by which a pouch forming, filling and sealing machine can be converted to handle different pouch pitches without rebuilding or relocating major drive components.

Another objective of the invention has been to provide methods by which a universal drive for a pouch forming, filling and sealing machine can be used with change components for pouches of different pitches.

Another objective of the invention has been to provide a method for converting a pouch filling and sealing machine from handling one pouch width or pitch to another pouch width or pitch not accommodated by mere adjustability or fine tuning built into the machine.

SUMMARY OF THE INVENTION

To these ends, a preferred embodiment of the invention contemplates a method by which a pouch filling and sealing machine for pouches of one width or pitch can be easily converted to fill and seal pouches of a substantially different pitch or width. The method includes the steps of replacing the vertical sealer wheel and the filler wheel with different respective wheels having different numbers of pouch stations than those replaced, but in, at least the case of the filler wheel, having essentially the same diameter as the filler wheel being replaced, and without regard to whether the number of stations on either wheel corresponds to whole degree increments about the wheels. The knife apparatus is also changed to cooperate with the new pouch pitch by change parts establishing either a different number of knife cuts or stations (per knife revolution) which corresponds to the new pitch, or change parts providing the same number of cutting stations but at a different pitch.

The diameter of the replacement filler wheel remains substantially the same even though the number of stations around the wheel change due to the new pitch or pouch width. This maintains the critical web orientation and tangential take off from about the filler wheel and tangentially into the top sealer, and substantially the same pouch or web speed, while accommodating a pouch width or pitch substantially different than the prior one.

In addition, it will be appreciated that the invention contemplates the preferred pouch machine will have a drive and transmission unit which stays consistent and is not rebuilt or changed through a conversion. The drive shafts and other components are generally mounted below a machine "table" and are universally used to drive the change parts above the table, i.e. the vertical sealer, filler and knife, on fixed drive axes. In this way, a manufacturer has only to engineer a single drive and transmission unit for his pouch machine. By applying a constant pouch production or web speed approach, as will be further discussed, for the full range of pouch pitches to be accommodated, the drive remains the same while changes to, or replacements of, the sealer, filler and knife accommodate widely varying pouch widths. The end users thus need not be concerned with the capital expense of an entire new machine which itself limits future conversions to handle changes in pouch pitch. Changeover on site in a short time with minimal cost of changeover parts is provided. By this standardization, engineering hours are reduced, assembly efficiencies are increased, and lead time for machine delivery reduced since the drives are no longer customized to a particular pitch.

Accordingly, a pouch machine according to the invention will include a drive and transmission unit including a drive table and, above the standard drive table, at least a changeable vertical sealer wheel, changeable filler wheel, and changeable knife to accommodate varied pouch pitch all at substantially constant maximum web speeds, and at suitable lesser speeds. The "constant maximum web speed" noted above is that maximum speed at which the web can be consistently sealed and filled. According to the invention, pitch changeovers can be made without derogation of the ability to run at such speeds and at other speeds within that upper limit.

The frame structure over the table is provided with openings to allow access to the table top and the changeover parts by lifts, and to allow space for removal and replacement of these parts.

As mentioned above, the filler wheel and vertical sealer are time based processes. Each requires a certain amount of time for the sealing or filling process to occur and, in the case of the sealer, there is a time limit due to potential seal propagation on stopping. One major factor of importance is how much time the web spends on each wheel. As web speed increases, a need for larger and larger filler and vertical sealer wheels were typically required. However, at a constant web speed, the required wheel diameters remained the same diameter, regardless of which pitch cut off is run on the machine. If the design would lock in on a constant maximum web speed, say 4000 in/min., it would be guaranteed of proper operation for any pitch and any run speed in pouches/minute up to a web speed of 4000 in./min. This would translate to locking in the following parameters which were, prior to this invention, historical variables:

a. Diameter of filler wheel and vertical sealer;

b. Shaft positions of: filler wheel, vertical sealer, tucking roll, first feed roll, cooling roller;

c. Speed of motor drives;

d. Product feed locations;

e. Size of top plate, base and main frame size with constant shaft hole locations.

Thus, use of the constant web speed approach, together with the concept of providing the desired numbers of pitches on each filler and sealer wheel, regardless of whether or not on standard degree increments, or any other increments, sets the parameters permitting the use of a standardized drive for all contemplated pitch changes.

Moreover, as the focus turns to constant diameters, the dilemma of non-integer angles (i.e. other than whole degree station increments) from station to station occurs. The filler wheel, of course, while referred to as a "wheel", is actually a multi-faceted polygon as opposed to round diameter. When viewed as a polygon, according to the invention, the number of stations are created in the polygon that ensures adequate fill time for a 4000 in/min. web. The polygons for any given pouch pitch will be very similar in nominal diameter across the wheel to each other, even though the pitches may not coincide with whole degree increments of the wheel as was necessary in the past due to machining capabilities or limitations.

The nominal diameters from cut off to cut off will not be exactly the same due to the fact that the stations can only increase in whole number station increments. For example, it is not possible to have a 42½ station filler wheel. Due to that incremental whole number station requirement, the diameters will float within an inch of nominal. Fine tuning of the diameter can be accomplished by allowing the allowable pouch reduction dimensions on the filler wheel to float within a tolerance of between 14% and 22%. Using this approach, diameter changes could be held within one-half inch so that diameters of filler wheels for varied pouch pitch are substantially the same. As used herein, "pouch reduction" means the reduction of the pouch chord between the seal edges as the pouch is opened on the filler wheel. Opening of the pouches on the filler results in a foreshortening of the web length for the number of pouches so opened.

Finally, to provide a standard transmission, a standard drive ratio between filler wheel and vertical sealer is selected in order to meet the objective that only tooling or components above the machine table top be changeable. It is not desirable to take apart the drive and transmission for ratio changes. By maintaining a standard ratio, with a standard max web speed of 4000 in./min., all shaft RPMs can be constant. According to the preferred embodiment of the invention, the ratio of 1.5 is selected, that being 1.5 pitches on the filler wheel for every 1 pitch on the sealer, in whole number increments (i.e. ratio of 2 pitches on the sealer for every 3 pitches on the filler wheel). Thus, when the vertical sealer is sized by raising or lowering the number of stations in groups of two, the filler wheel will always have a whole number station.

Accordingly, the invention departs from the old, prior methodology of design by looking to constant web speed, discarding adherence to whole degree increments of stations on a sealer or filler wheel and selecting a single ratio of filler wheel to sealer wheel stations. Thereby, pouch machines can be provided with standard drives, easy and inexpensive changeover to different pitch and all while maintaining a high production speed on the order, for example, of 4000 inches per minute web speed.

The advantages of the invention are revolutionary in the pouch field. These include from the end users' perspective:

1. Convertibility to accommodate market/pouch size changes without significant equipment expenses and equipment obsolescence.

2. Pouch markets may expand by providing similar products in various size packaging.

3. A reduction in manufacturing floor space occurs due to machines being able to handle various products.

4. A high speed convertible machine will allow work in process inventories to decrease based on the ability to respond to multiple product configuration in a high speed production mode.

5. Reduced capital equipment expense per pouch produced as a result of maximizing each machine's utilization potential.
6. Historically, pouch machine manufacturing, due to the old design concepts of the machine, has evolved into a custom designed and custom built machine for each specific application. This has translated into machine build projects that have high engineering design content (an average approximately 2,000 hours of engineering), as well as considerable cost and lead time. Lead order time is much reduced.

Advantages from the manufacturer's perspective include:

1. Elimination of custom designed and built machines dedicated to single pouch pitches. A machine that attempts to standardize all that can possibly be standardized, while minimizing variable parts to as few as possible, would have the following effect on manufacturing cycles.
   a) Reduction of engineering time;
   b) Standardization of all drives and other parts;
   c) Build documentation could be immediately submitted to manufacturing upon receipt of the order for all portions of the machine that are standardized, resulting in reduced delivery lead times; and
   d) Multiple lot manufacture automatically reducing lead times by allowing pre-assembled machine drives that are awaiting final assembly of variable tooling and providing other economics of scale; and
2. Manufacturing cost reduction due to:
   a. Reduced engineering hours: It is anticipated that a standard machine will drop the requirements of customized engineering from several thousand hours to less than one thousand hours, most of which would be product application specific.
   b. Improved assembly time due to assembly department familiarization of design; and
   c. Reduced part variability and reduced part machining cost due to the advantage of NC programming and tooling set-ups.

These and other advantages will become readily apparent from the following detailed description of the invention, and from the drawings in which.

Turning now to the drawings, it will be appreciated that the Figures are presented as illustrating, in combination, a pouch forming, filling and sealing machine, according to a preferred embodiment of the invention, with a pouch web supply and a cut-off knife associated therewith. While FIG. 1 illustrates such a system with the web feed and cut-off knife standing apart from the frame unit on which the sealer and filler wheels are located, it will be appreciated that the web feed and cut-off knife components could be formed as an integral part of or on the machine and machine frame.

It will also be appreciated that while certain particulars of one apparatus on which the methods claimed herein are carried out is disclosed, the methods disclosed and claimed herein are not specifically dependent on a particular apparatus, and that any suitable apparatus, such as the mechanisms for mounting and supporting the sealer wheel, filler wheel or knife, for example, could be used to carry out the methods, the particular apparatus features not constituting a part of the invention as claimed herein.

Figure 1:
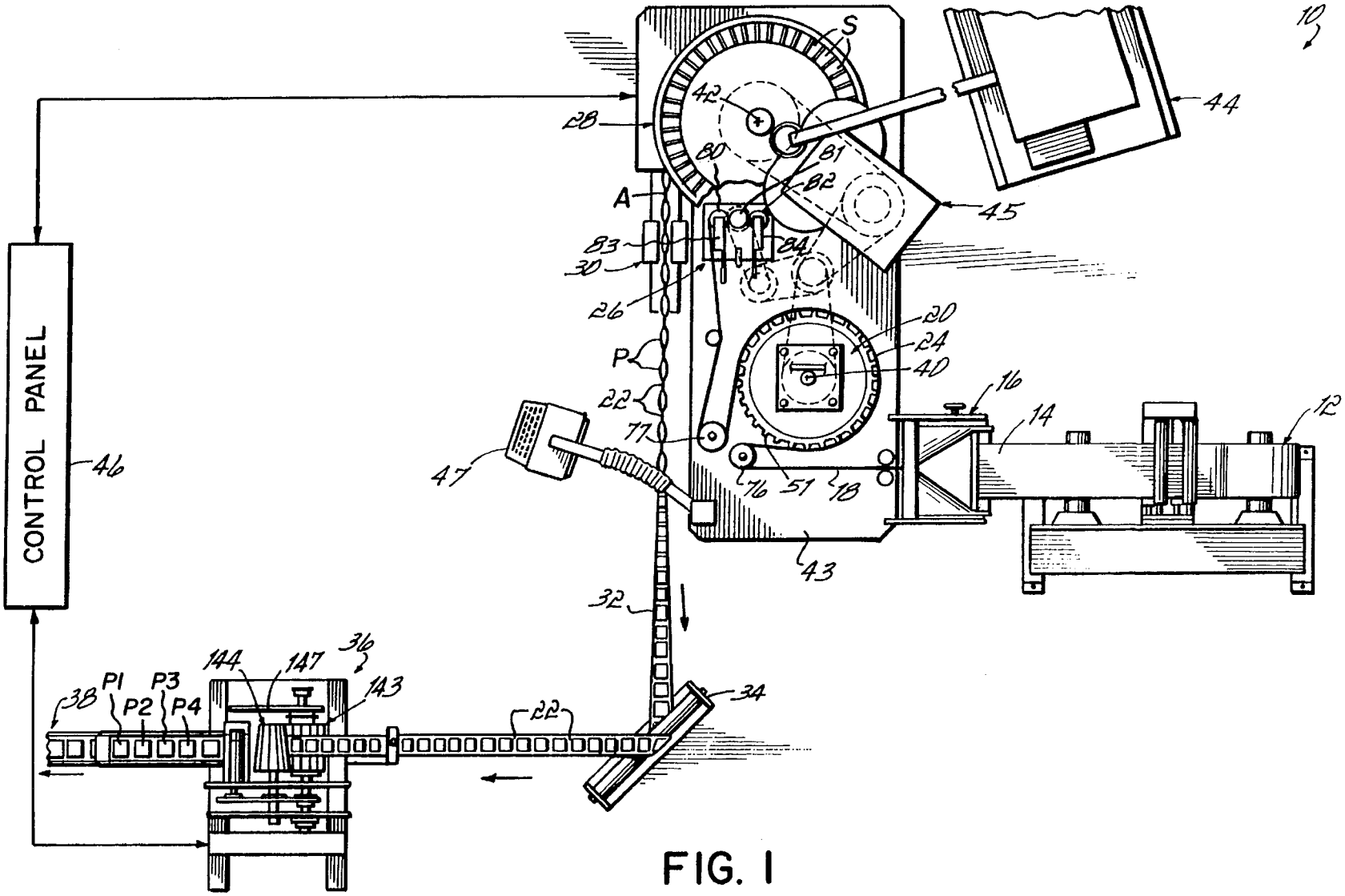
FIG. 1 is a plan view of a pouch forming, filling and sealing machine according to the invention.

In FIG. 1, there is illustrated a pouch forming, filling and sealing machine 10 on which the methods of the invention can be carried out. The entire system for forming open ended pouches in a web train, filling them, sealing them, and cutting them off includes: an on-the-fly splicing flat web supply 12 for feeding a flat web 14 and a plow 16 for folding the moving web onto itself, lengthwise into a folded web 18, a first vertical sealer wheel 20 for creating vertical seals 22 in the folded web to form a web train 24 of open-ended, adjacent pouches, and tuck roller assembly feeding the folded and vertically sealed web 24 to a filler wheel 28.

From there, pouches P exit substantially tangentially to a pouch feed path, represented by the arrow A, through a top sealer 30 where the now-filled pouches P in the train are sealed across their top ends. From top sealer 30, the now filled and sealed pouch train 32 id directed about a break bar 34 to a rotating knife 36 for cutting individual pouches (P-1 to P-4) off the web train and depositing them on a conveying or cartoning apparatus 38.

The vertical sealer wheel 20, tuck roller assembly 26 and filler wheel 28 are each mounted on respective fixed drive axes 40, 41 and 42 extending through a machine table top 43 of machine 10. Top sealer 30 is oriented in a fixed position on or with respect to machine 10 and top 43 so that pouch feed path A is fixed relative to drive axis 42.

A product weigh scale or auger dispenser apparatus 44 is oriented for operable connection with a filler 45 oriented over the filler wheel 28 for dropping product through spouts S of the filler wheel 28 into the open tops of pouches into which the spouts S are inserted.

A control 46 is shown diagrammatically on FIG. 1 and may take the form of terminal 47 on machine 10 for controlling the machine in a well known manner.

For a further understanding of the invention, certain features of the machine 10 will now be described.

Vertical Sealer

Figure 3:
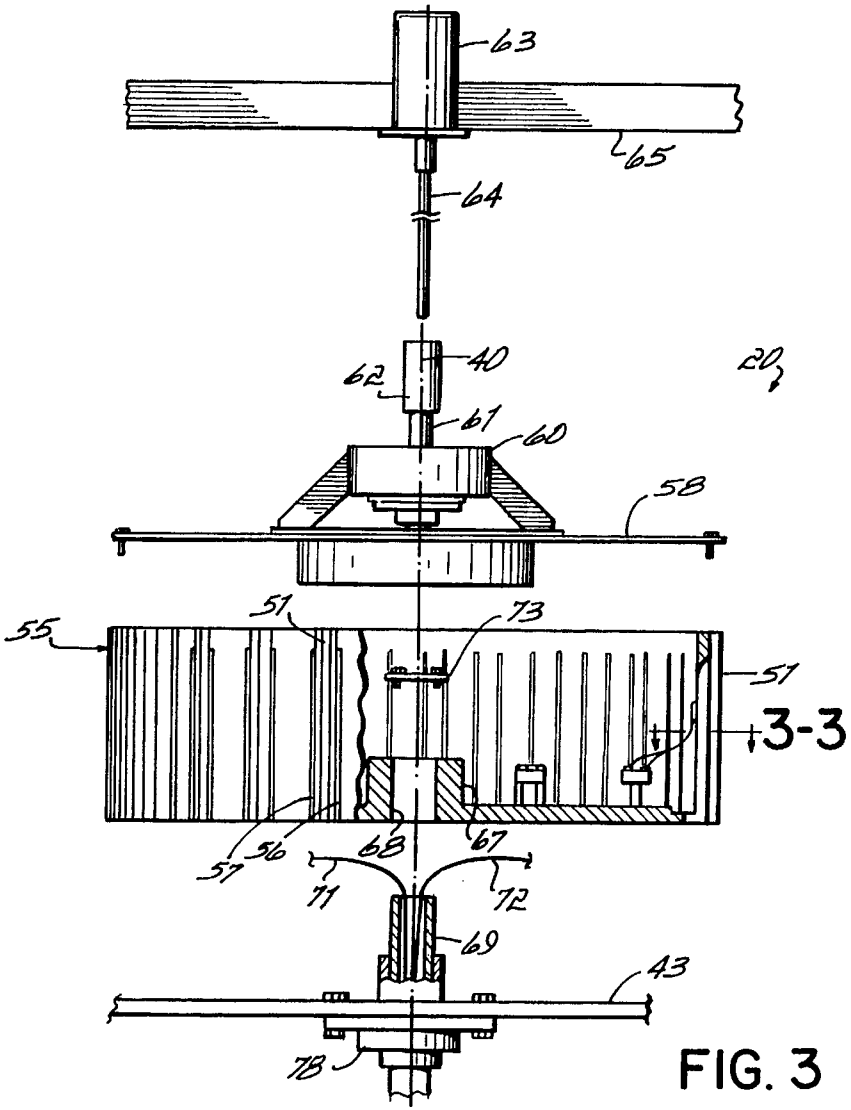
FIG. 3 is an illustrative view similar to FIG. 2 but showing the sealer wheel removed from the machine of FIG. 1 for replacement.
Figure 2:
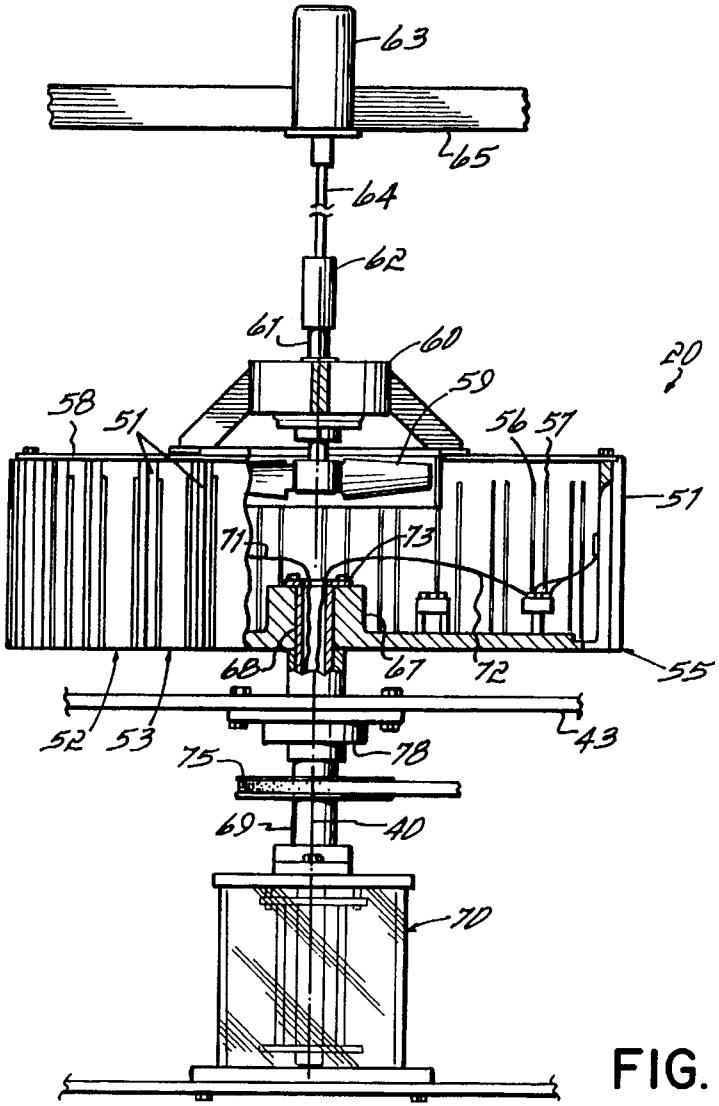
FIG. 2 is an illustrative cross-sectional view of the replaceable sealer wheel shown in FIG. 1.
Figure 3A:
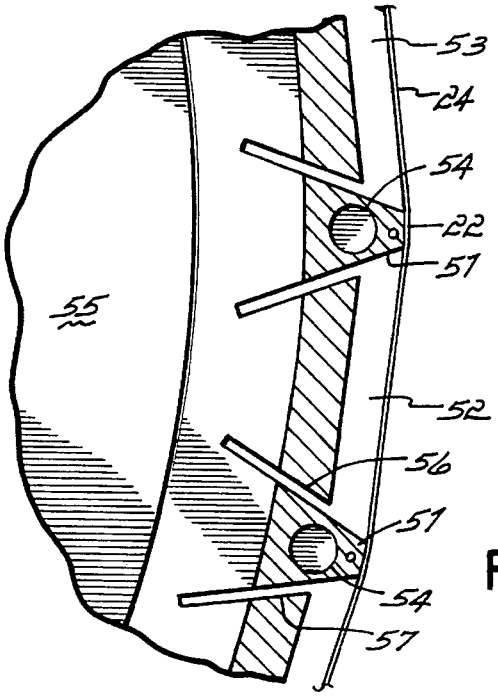
FIG. 3A is a cross-sectional view taken along lines 3A—3A of FIG. 3.

The vertical sealer 20 essentially comprises a wheel defined by a plurality of vertical sealing lands 51, defining between them, a so-called pouch station, such as adjacent stations 52, 53 (FIGS. 2 and 3A). FIG. 1 diagrammatically illustrates twenty-eight (28) lands 51 defining 28 such pouch stations. Each of the lands 51 is preferably provided with a longitudinal bore 54 within the land for receiving a heater and each of the lands 51 is separated from a drum 55, comprising the sealer 20, by means of slots, such as at 56 and 57, for isolating the lands from the drum and for accommodating a cooling flow of air onto the pouch web at times when the drum is stopped, to inhibit undesirable seal propagation (see FIG. 3A). The drum is provided with a cover 58. A fan 59 is mounted in the top of the cover by means of the support bracket 60. The fan has a drive shaft 61 connected to a collar 62. A fan motor 63 is provided with a shaft 64 releasably attached to the collar 62 for driving the fan 59. The fan motor 63 is mounted to a super structure or frame of the machine 10, as illustrated by the frame 65. The drum 55 is provided with a boss 67 defining a drive bore 68 for receiving a drive shaft 69, extending upwardly on drive axis 40 through the table 43 of the machine 10. A commutator apparatus 70 is provided at the lower end of the drive shaft 69 for supplying electrical power to the leads 71, 72 for heaters in the vertical sealer. A pulley 75 is secured to the driveshaft 69 for providing rotation to the vertical sealer 20.

When the drum 55 turns, the fan 59 is preferably off so there is relative motion between fan and drum. Ambient, cool air is constantly drawn into the drum. When the machine stops, drum 55 stops and fan 59 is turned on to blow cooling air through slots 56, 56 onto the web 24 to inhibit seal propagation.

Figure 10:
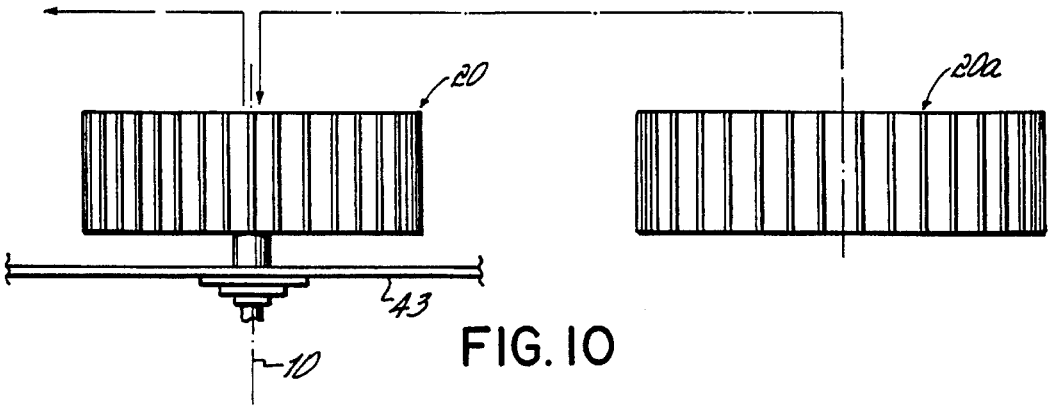
FIG. 10 illustrates replacement of a sealer wheel according to the invention.

It will be appreciated that the vertical sealer 20 is readily disassembled and removed for substitution by another vertical sealer in accordance with the invention, as illustrated perhaps best in FIGS. 2, 3 and 10. The conversion process includes disconnecting the fan motor 63 and a support 65 and lifting it upwardly so that shaft 64 is withdrawn from the collar 62. The cover 58 is then removed from the drum 55 and the power and thermocouple leads 71, 72 are disconnected. The shaft retainer 73, which can be a snap ring or other fastener, for example, for holding the drum 55 on the drive shaft 69, is removed and the vertical sealer comprising the drum 55 is lifted off the drive shaft 69. For replacing that vertical sealer 20 back on to the machine 10, or any other vertical sealer 20 back on to the machine, the leads 71, 72, which may comprise heater power leads and thermocouple leads, for example, are threaded back through the bore 68 and the drum is lowered over the drive shaft 69 into position. The retainer 73 is connected to the drive shaft to hold the drum thereon and the fan and cover assembly is secured back to the drum. The fan motor 63 and its support 65 are then lowered over the sealer so that shaft 64 enters collar 62 and the components are secured for operation.

It will be appreciated that further details of the vertical sealer, which do not in an of themselves constitute a part of this invention, are shown in a U.S. patent application entitled "Low Thermal Inertia Sealer", naming Martin Wildmoser as inventor (attorney docket no. J&C-140) and filed on even date herewith, such application being expressly incorporated herein by reference.

It will be appreciated that the web sealing process on the vertical sealer is a function of time and temperature. Thus, at a given web speed about the sealer, a suitable sealing land temperature is generally required to produce a desired seal. When the machine stops, the land heaters are controlled to reduce the lands to a lower temperature or set point which is still sufficient to provide acceptable seals on start up, all to reduce the rate of seal growth or propagation during stoppage. The fan 59 facilitates this land cooling. Nevertheless, it may also be practicable to eliminate the fan where the blowing of air is not necessary to produce the desired temperature change. For example, if the intervening target cool down temperature or set point temperature is enough to apply a workable seal to the stopped web, and is not too much less than the normal operating temperature or set point, the fan can be eliminated.

Elimination of the fan is in fact, preferable, since if there is no fan, the change over procedure for changing the sealer wheel to one with a different pouch pitch is significantly simplified. This advantage may out weigh the desire to eliminate seal growth on the stopped sealer drum within, of course, acceptable operable levels and parameters.

Referring back momentarily to FIG. 1, it will be appreciated that the vertical sealer 20 has a nominal diameter across the drum 55 and between lands essentially on opposite sides of the drum. It will also be appreciated that the pouch web 18, as it is entrained around the sealer 20, takes the form of a straight web across each pouch station between the lands 51. Thus, the operational configuration of the sealer is actually a polygon approximating a circle with small pouch lengths between each lands making up the outer periphery of an imaginary polygon or circle, such periphery referred to herein generally as a "circumference".

It will be appreciated from FIG. 1 that web rollers 76, 77 are utilized to entrain the folded pouch web 18 about the sealer 20 and, as the sealer rotates, the heated lands 51 apply vertical seals to the folded-over pouch web to produce a sealed pouch web 24 (comprising a train of adjacent pouches having open, or rather, unsealed top ends) which exits the sealer around the discharge or positioning roll 77. It will also be appreciated that the vertical sealer 20 is driven rotationally about the drive axis 40 through a belt and pulley or chain and sprocket drive, which is illustrated by the dotted lines of FIG. 1. The drive axis 40 and the drive shaft 69 is in a fixed position with respect to the machine 10 and the table top 43 so that the drive shaft 69 about axis 40 is mounted, for example, in a bearing 78 (FIGS. 2, 3) mounted to the table top 43.

Tuck Roller

From the sealer 20, the vertically sealed, doubled over pouch web 24 is directed to a tuck roller assembly 26, where the web 24 is entrained around a backup roll 80, a drive roll 81 and a tuck roll 82. The backup roll 80 and tuck roll 82 are rotationally mounted on respective swing arm mechanisms 83, 84 and are biased toward the drive roll 81 for pinching the web therebetween, so that the web is wrapped about the drive roll about 180 degrees, and about the backup roll 80 slightly over 180 degrees. This provides a positive web drive by the tuck roll assembly 26, with no slippage of the web. The tuck roll is positioned operationally adjacent the general circumference of the filler wheel 28 for introducing the folded and vertically sealed web 24 to the succession of pouch filling stations defined around the operational periphery of the filler 28.

It will be appreciated that the tuck roll assembly can be mounted such as by bolts and slots in the table top 43 so as to be slightly adjustable to insure accurate positioning of the tuck roll assembly with respect to the filler wheel 28. In this regard, the tuck roll assembly is driven by a drive belt beneath the table top 43 from a magnetic particle clutch (not shown) for applying a predetermining controllable torque to the drive roll 81, and thereby a predetermined tension to the web 24. The drive roll 81 is provided with gears which mesh with drive gears for the backup roll 80 and for the tuck roller 82, so that all three rollers are positively driven through the magnetic particle clutch to drive the web 24. It is contemplated that any slight adjustment of the position of the tuck roller assembly 26 will not interfere with the drive from the magnetic particle clutch, such that any adjustment of the position of the tuck roll assembly would be at essentially the same radial distance from the drive axis of the clutch.

It will be appreciated that the tuck roll assembly, in and of itself, constitutes no part of this invention. The assembly is not design-dependent on pouch pitch. Further details of that assembly, however, can be seen from applicant's copending application entitled "Tuck Roll With Improved Web Tension Control" naming Martin Wildmoser as inventor (attorney docket no. J&C-147) and filed on even date herewith, such application being expressly incorporated herein by reference.

Filler Wheel

From the tuck roller apparatus 26, the web is introduced to the filler wheel 28, the tuck roller apparatus 26 serving to tension the web 24 and to drive it onto the filler wheel 28. One suitable filler wheel is shown, for example, both in FIG. 1 and in FIGS. 4 and 5. The filler wheel comprises, in combination, a spout wheel 90 having a plurality of spouts S and, in particular, spouts such as those shown at 91 and 92 in FIG. 4. It will be appreciated that the filler wheel 90 is mounted for rotation about an axis 93, which is slightly tilted from the vertical axis 42 so that the filler wheel 90 is disposed in a plane which intersects the preferably horizontal plane of the pouch support wheel 95. Pouch support wheel 95 is provided with a plurality of vacuum lands 96 connected to vacuum lines 97. Vacuum lines 97 are connected to a hub 98 and to bores 99 therein. These bores extend to a seal 100 for interconnection to an arcuate vacuum slot 101 in a drive support hub and vacuum reservoir 102. Thus, as the hub 98 turns with the pouch support wheel 95, vacuum is imparted to the vacuum lands 96 through the seal 100, bore 99 and vacuum line 97, when the ports in the shoe **100*a* are in operative communication with the vacuum plenum 101, which is in the form of an arcuate slot. Thus vacuum is applied to the vacuum lands 97 during a sector of the rotation of the filler wheel 28 beginning at a time when the folded and partially sealed web 24 is introduced to the filler wheel 28 by the tuck roller assembly 26, and ending at the time the vacuum train is discharged from the wheel toward the top sealer, as will be described. The hub 98 is keyed to a drive shaft 104, extending upwardly through bearing 105 and table top 43 about the drive axis 42. It will, of course, be appreciated that the drive axis 42 is preferably vertically oriented and thus intersects the tilted axis 93 of spout wheel 90**.

The spout wheel 95 is also provided on axis 42 with an angled bearing 108 and hub for receiving the pivot shaft 109 on tilted axis 93 for the spout wheel 90. The spout wheel 90 is carried on a hub 110, which is rotationally mounted by bearings on a shaft 111 depending from support 112. Pouch wheel 95 is provided with an upstanding bracket 115 attached to a filler wheel spring 116. The opposite end of the spring is attached to a spring post 117 mounted on the spout wheel 90. When pouch support wheel 95 rotates, it drives spout wheel 90 by pulling it through bracket 115, spring 117 and post 117. This flexible drive link permits the spout wheel 90 to rotate on an inclined plan and move downwardly in a filling sector so spouts (see spout 92) are inserted into the open tops of the pouches (FIG. 4).

The filler wheel 28 further includes a tuck wheel 120 carrying a plurality of tucking fingers, such as at 121, driven by cam followers 122 riding in an eccentric cam track 123 of the cam ring 124 about axis 42. These tuck fingers are raised as the pouches about filler wheel 28 come beneath the spouts for filling in the filling sector, such that the bottom of the pouch is pushed upwardly to thereby facilitate a full opening of the bottom of the pouch so it can be filled. Thus as viewed in FIG. 4, for example, the eccentric cam track 123 directs followers 122 radially outwardly to the right to raise the tuck finger 121 against the bottom of the pouch, just prior to filling through the spout 92.

It will also be appreciated that as the various components of the filler wheel apparatus 28 turn, the spouts S are selectively engaged and disengaged into the open ended tops of the pouches by virtue of the inclined orientation of the spout wheel 90 and the horizontal orientation of the pouch wheel 95. Thus, the end of the spouts rotate down into the open pouch ends and then are lifted upwardly therefrom, the spout ends being in the pouches when product is dropped through the spout into the pouch.

Figure 4:
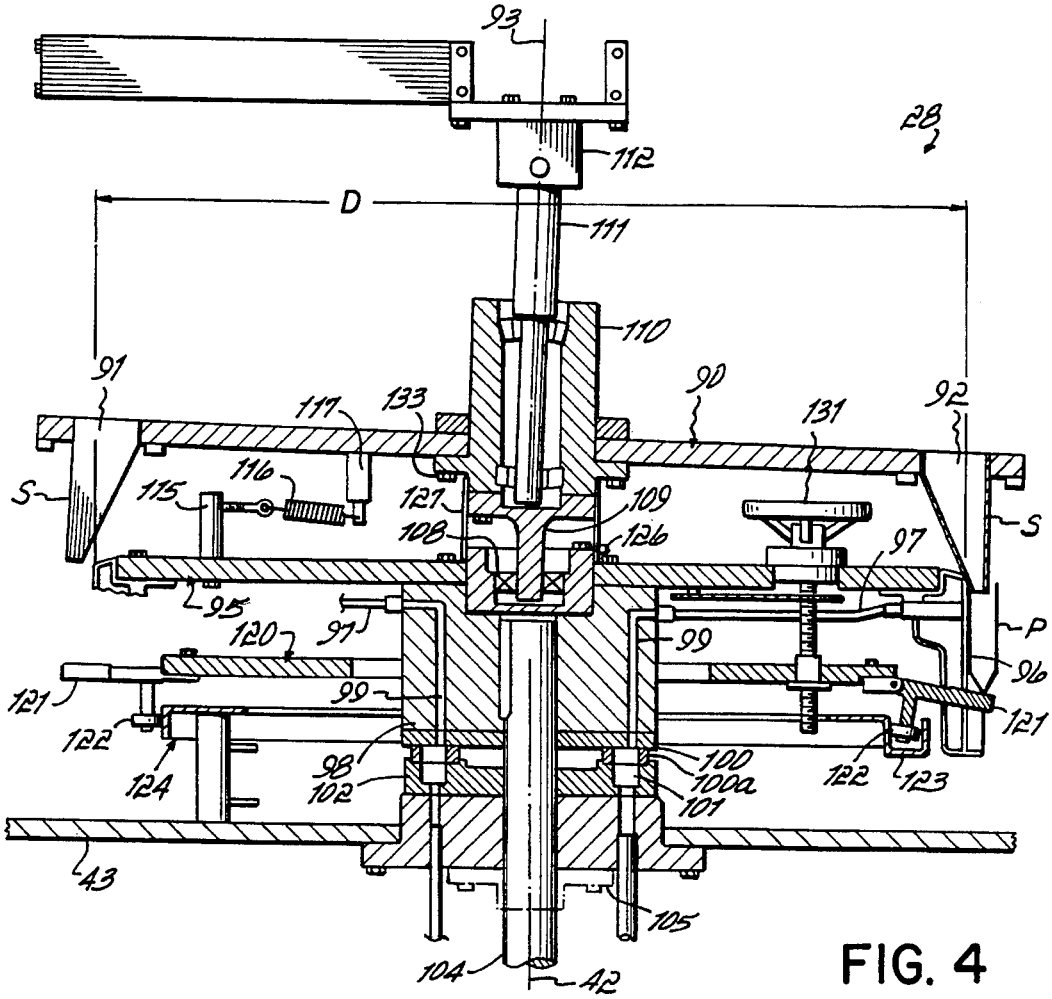
FIG. 4 is an illustrative cross-sectional view of the replaceable filler wheel shown in FIG. 1.

It will also be appreciated that the filler wheel apparatus 28 has an operational diameter D, as illustrated in FIG. 4, across the pouch wheel and, in particular, between the lands supporting the pouches on opposite sides of the wheel. Essentially the diameter D, then, is defined by filler wheel 28, but more particularly is that distance between the lands supporting the pouches wrapped about the wheel at 180 degrees on opposite sides thereof. The general periphery of the filler wheel actually may be in the form of a polygon, however, it will generally be referred to as a "circumference". References to the diameter of the filler wheel apparatus 28 are for the purposes of this description to the diameter D as described above. It is appreciated that various features of the pouch filler wheel 28 may extend outwardly beyond this diameter, such as for example, portions of the spouts S, portions of the spout plate 90. The effective diameter D, however, and the tangential relationship of the circumference defined by that diameter and its tangency to the pouch sealing path A, as will be discussed, is of important consideration in this invention.

Thus, with further reference to FIG. 1, it will be appreciated that the pouches P are discharged from the periphery of "circumference" of filler wheel 28 on a line which is generally tangent to the "circumference" (defined by the diameter D) and which is also in alignment or co-linear with the pouch sealing path A through the top sealer 30. Thus, the pouch train exits the filler wheel and moves straight into the top sealing path through sealer 30 without any path or directional deviation. It is not necessary to re-route or disturb the filled but un-sealed open-ended pouch train as it moves toward the top sealer.

Figure 5:
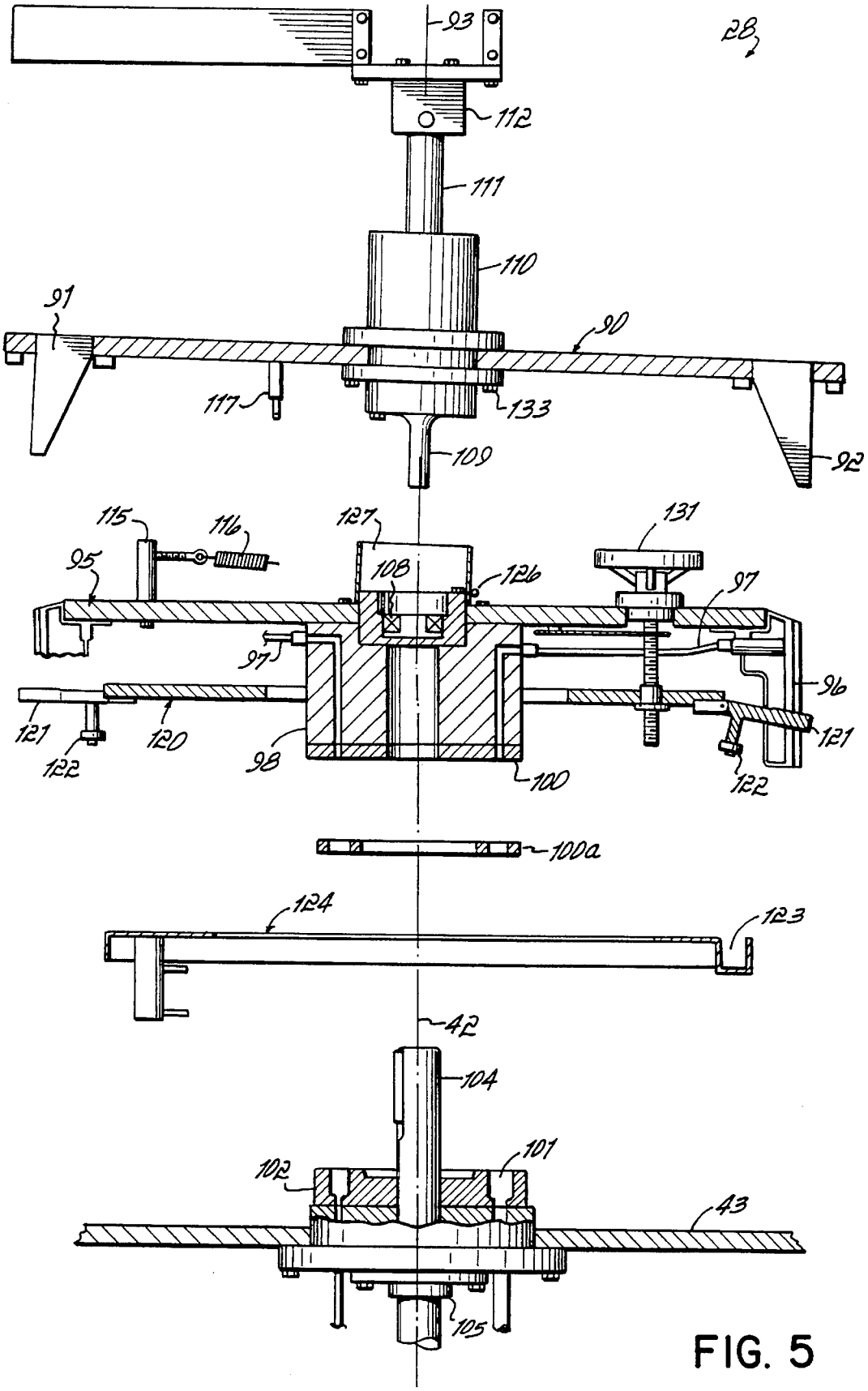
FIG. 5 is a cross-sectional view similar to FIG. 4 but showing the roller wheel components dismounted for replacement.
Figure 11:
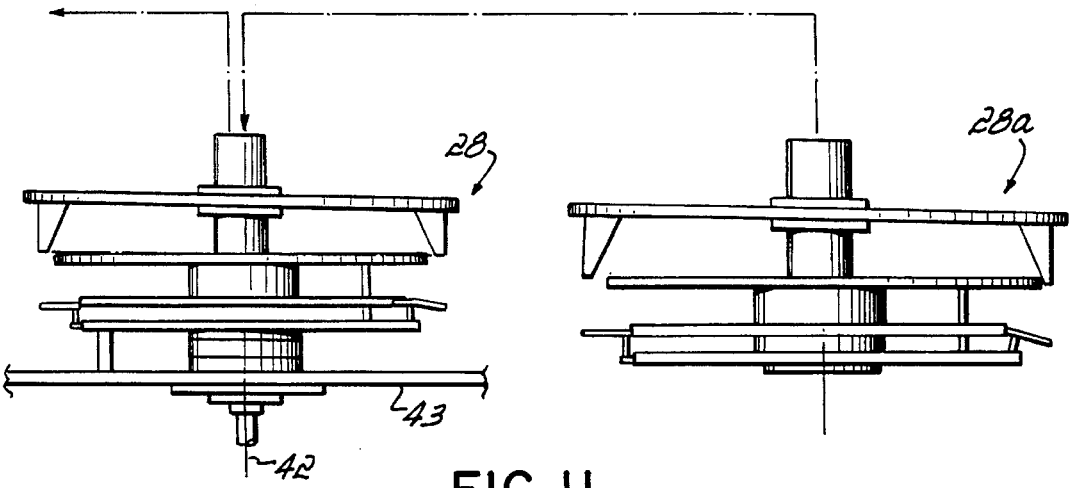
FIG. 11 illustrates replacement of a filler wheel assembly according to the invention.

Turning now to FIGS. 4, 5 and 11, it will be readily appreciated how the pouch filler wheel 28 can be removed and replaced by another pouch filler wheel 28 having a different number of pouch stations. In this regard, it will be appreciated that a pouch station, with reference to the filler wheel 28, is defined by a vacuum land 96 for opening the center of a pouch and also preferably by the existence of a spout S above each land so that there is a like number of spouts and vacuum lands. Each pouch, of course, is defined between the vertical seals which are placed by the vertical sealer 20 mentioned above. When the pouches are introduced to the filler wheel 28 by the tuck roller apparatus 26, the pouches are opened partially by virtue of the speed of the pouch web as it is driven or pushed onto the filler wheel 28 and by virtue of the vacuum applied through the pouch centered lands 96 so that the pouch tops are open for receipt of the descending bottom ends of the spouts.

It will also be appreciated that the number of pouch stations on the filler wheel 28 bears a certain relationship or ratio to the number of pouch stations on the sealer wheel 20. This ratio is preferably 2:3. That is, there are preferably 1.5 times as many pouch stations on the filler wheel 28 as there are on the sealer wheel 20. While other ratios could be used, the 2:3 ratio has been discovered to be preferable. For example, filling generally requires 1.5 times longer than sealing in many typical pouches, webs and products.

Filler wheel 28 may be removed and another filler wheel, having a varied number of pouch stations, mounted on the drive axis 42 for cooperation with a sealer either already on the machine or being replaced thereon.

Figure 9:
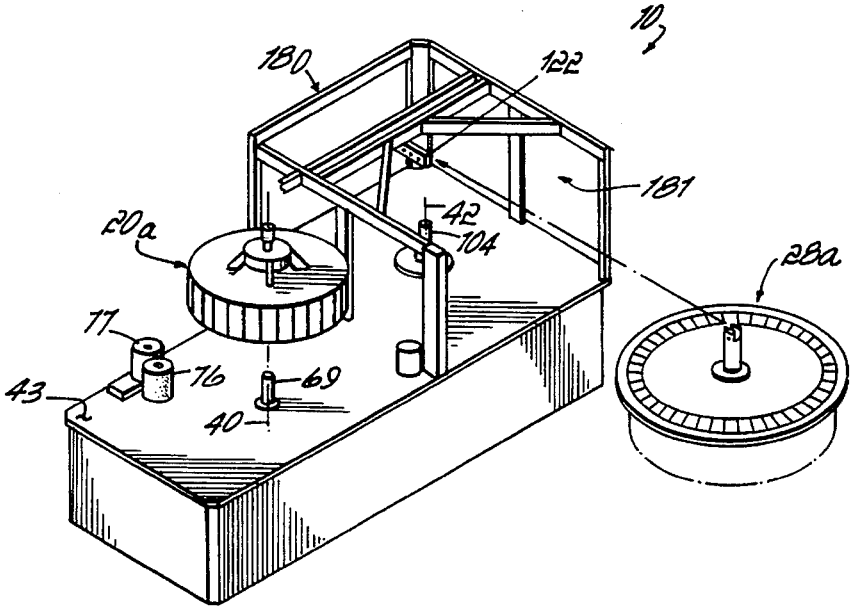
FIG. 9 is a diagrammatic perspective view illustrating the replacement of the sealer and filler wheels according to the invention.

As will be readily apparent from FIGS. 4 and 5, the filler wheel 28 can be removed and another filler wheel replaced by the following steps. It will be appreciated that the machine is configured preferably with no framework in the removal path of the filler wheel. In any event, replacement is begun with removal of any cover structure above the filler wheel. With reference to FIG. 9, it will be appreciated that the super structure above the table top 43, such as the frame work shown in FIG. 9 for supporting the filler units 45, is designed to provide enough clearance for lifting of the filler wheel components and the lateral movement of the filler wheel outwardly away from the machine for replacement. In this regard, the upper braces, such as brace 112, are removed from the additional frame work and a sufficient number of spouts are moved to gain access to the filler wheel springs 116 and to the bellows clamp 126 about the bellows 127, which extends between the spout plate 90 and the pouch wheel 95. The spout wheel 90 can thus be lifted up and off the pouch wheel 90. Thereafter, the pouch wheel 90 is lifted off the drive shaft 104 and the vacuum shoe can be removed as necessary. It is contemplated for most conversions that, given the tuck finger adjustment, the same cam ring assembly can be used. If it is necessary to change the cam ring, the bolts holding the cam ring assembly must be undone from the table top 43 and the cam ring assembly also lifted off the apparatus. This exposes the drive shaft 104 on the drive axis 42 and the vacuum reservoir 102. Thereafter, another filler wheel assembly 28 can be assembled onto the drive shaft 104 and drive axis 42. A new cam ring assembly 124 with a number of tuck fingers corresponding to the new number of pouch stations about the new filler wheel, is installed and secured. The vacuum shoe is installed, then the pouch wheel, together with its hub 98 and wheel 95 and the tuck finger 121 assembly, is lowered onto the drive shaft.

The tuck fingers 121 can then be adjusted with respect to the cam followers 122, so that the tuck fingers are lifted the appropriate distance as the cam follower follows the cam track 123 for facilitating the opening of the bottom of the pouch. In this regard, a hand adjustment screw 131, which extends through the pouch wheel 95 into the disc or tuck wheel 120 supporting the tuck fingers 121, can be rotated to adjust the disc 132 upwardly or downwardly for the purpose of moving the fingers collectively up a down as a unit, for handling pouches of different heights. The spout wheel 90 is then lowered onto the pouch disc 95 with the drive shaft 109 inserted into the bearing 108. The pouch wheel is adjusted rotationally until the spouts S are each indexed with a vacuum land 96 and the spout wheel adjustment screws 133 are then tightened to secure the rotational orientation of the spout wheel 90 with respect to the disc 95 and the pouch lands 96. The filler wheel springs 116 are then connected to the spring posts. The bellows 127 is secured to the pouch wheel 95 and the spout wheel 90, respectively, and the support frame bracket 112 and its associated framework is secured.

It will be appreciated, as noted above, that the filler wheel 28 so replaced on the drive axis 42 is held generally within certain diametral parameters, i.e. so that its periphery a "circumference" when mounted is generally tangent to the pouch sealing path A through top sealer 30.

The number of pouch stations, i.e. vacuum lands 96 in the filler wheel apparatus 28 bears the same ratio to the sealer wheel with which this pouch wheel will be used, as did the stations on the old pouch filler wheel 28 to the stations on the prior sealer wheel. In particular, the ratio of the pouch stations on the new sealer wheel to the new filler wheel is 2:3. Secondly, it will be appreciated that the effective diameter of the new filler wheel is approximately the same diameter D as that of the filler wheel it replaced, even though the number of pouch stations on the filler wheel may be different. Accordingly, the effective circumference defined by the new filler wheel 28, that is, essentially through the longitudinal center line of the pouches wrapped about the filler wheel 28, is essentially tangent to the pouch sealing path A (FIG. 1) through the top sealer, as was the same circumference on the prior filler wheel. This relationship is held, even though the drive axis 42 has not been moved and extends upwardly from the table 43 in the same position, as it was for the prior filler wheel. Accordingly, filler wheel changes are accommodated by using the same drive axis 42, which does not require any change to the drive beneath the table top 43, by virtue of the maintenance of the same ratio of pouch stations between the sealer and filler wheel, and by virtue of holding the diameter of the respective wheels essentially constant.

It will be recognized that there may be some very slight variation in the diameters of the filler wheel. However, because the location of the pouch stations on the filler wheels are not, according to the invention, limited to standard degree increments about the wheel, any number of pouch stations (maintaining the station number ratio requirements) can be disposed about the filler wheel. Thus the outer circumference of the filler wheels 28 are maintained in approximately the same orientation and position for all filler wheels, thereby maintaining the tangency of the pouches departing from the filler wheel with the sealing path A. It will also be appreciated that even if the diameter of the filler wheel apparatus 28 changes insignificantly, the tuck roll apparatus 26 can be moved to a position slightly differently but at essentially the same radius from the magnetic particle drive clutch, in order to perform the same function of tensioning the web to the tuck roll apparatus and for driving the web onto the filler wheel 28.

It will also be appreciated that if the particular number of pouch stations selected for the filler wheel 28 would cause more than an insignificant or inconsequential diameter change in the new filler wheel, at least a part of this change can be accommodated by varying the degree to which the mouths of the pouches about the filler wheel are opened. That is to say that the opening of the pouches can be varied within a range of about 14 to about 22 percent reduced chord as compared to a 100% taut web in order to accommodate spacing requirements of the pouch stations about the filler wheel 28. In particular, it will be appreciated that as the pouches are opened more fully, the chord line between the seals in a single pouch is shortened, whereas if the pouches are opened a lesser amount, that chord line is lengthened. As these chord lines are lengthened or shortened, the overall circumferential length traversed by a specific number of pouches, is slightly lengthened or shortened. Applicants have found that within this 14 to 22 percent approximate range of freedom for opening the pouch mouths, any slight diameter changes generated by a change in the practical number of pouch stations about the filler wheel 28 can be accommodated without significant change to the actual operational diameter of the filler wheel 28 as described above, and thus tangency with top sealer path A is maintained.

Convertible Pitch Knife

The invention also contemplates the utilization of a convertible pitch knife which can be changed over to accommodate the various pitch changes afforded by changeover on the sealing and filling machine 10. In this regard, a preferred embodiment of the invention includes the utilization of a convertible pitch knife described in applicant's copending United States patent application entitled "Convertible Pitch Knife Apparatus" naming Paul E. Dieterlen as inventor (attorney docket no. J&C-139), and filed on even date herewith, such application being expressly incorporated herein by reference. In this regard, reference is also made to applicant's copending application entitled "Variable Count Direct Deposit Knife" naming Paul E. Dieteden as inventor (attorney docket no. J&C-138) and filed on even date herewith, such application also being expressly incorporated herein by reference.

Figure 6:
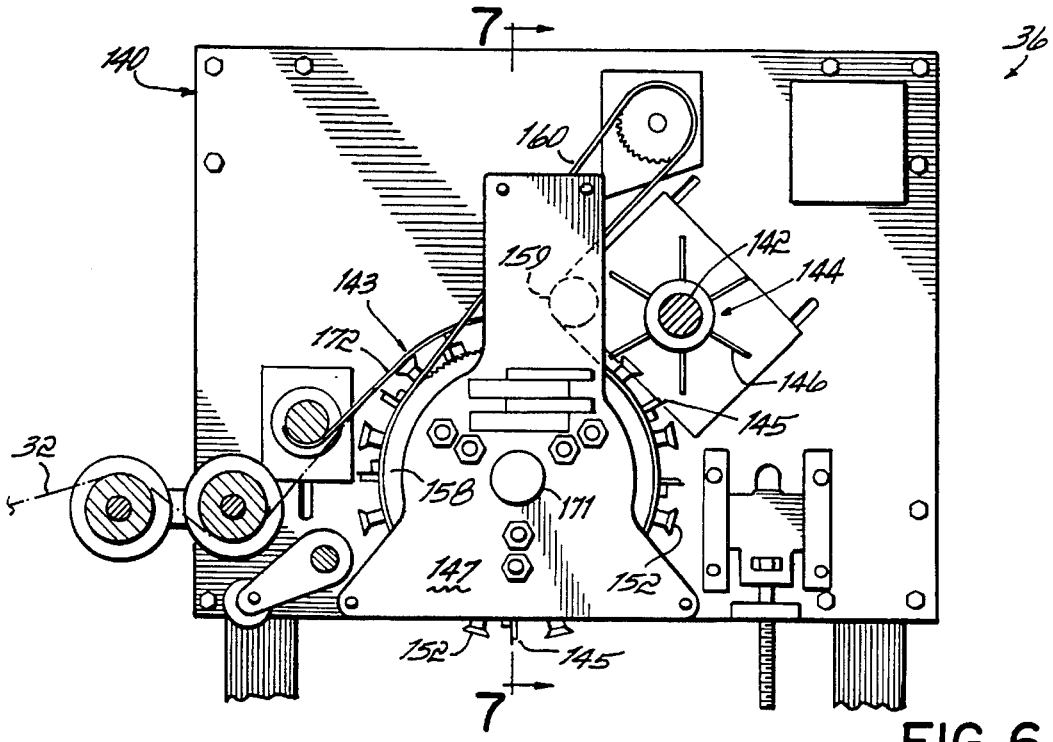
FIG. 6 is an illustrative elevational view of a knife for cutting pouches from a web train of pouches.
Figure 7:
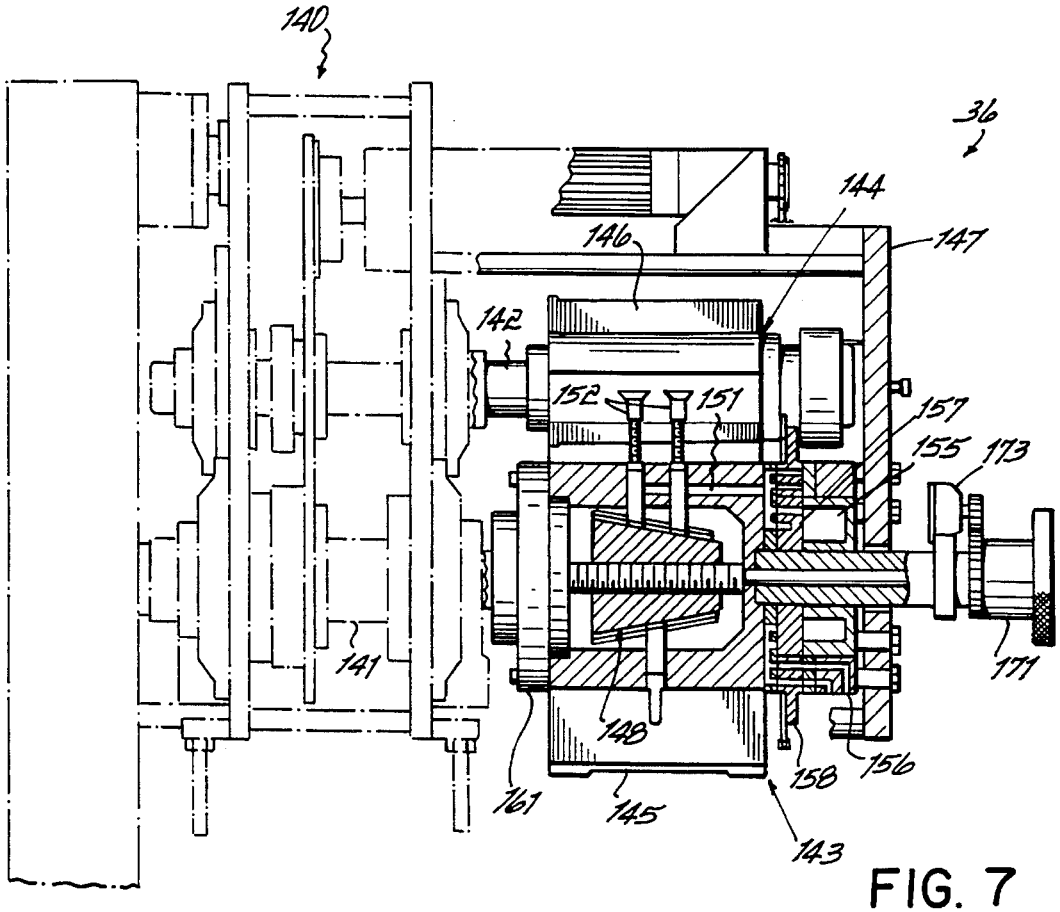
FIG. 7 is an illustrative cross-sectional view taken along lines 7—7 of FIG. 6.
Figure 8:
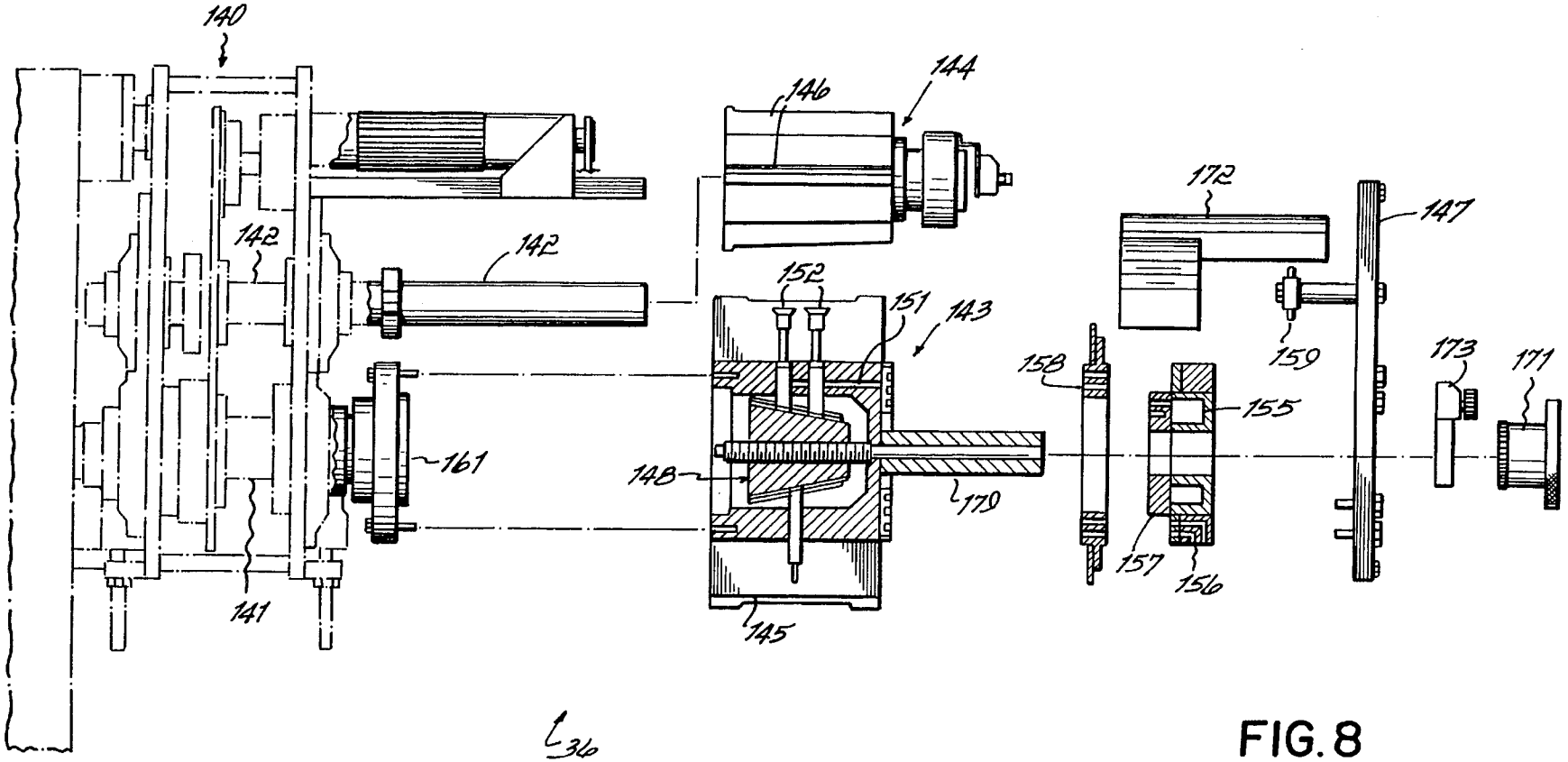
FIG. 8 is an illustrative view like FIG. 7, but showing components of the knife dismounted for conversion.

The features of a convertible pitch knife useful with this invention are shown in FIGS. 1, 6 through 8 and 12 of the Figures. Reference is also made to the foregoing incorporated patent applications for further details for background purposes, and which do not form a part of the invention of this application. In application's prior U.S. Pat. Nos. 4,872,382 and 5,222,422, there are disclosed various adjustable cutoff knives for cutting individual pouches from a web train of pouches from a forming, filling and sealing machine. These knives include certain features permitting adjustment of the knives and/or the pouch guides associated with the knives, for accommodating slight pouch changes, such as those occasioned by different configurations of pouch fill and the like. Nevertheless, such adjustments were not generally sufficiently large enough to accommodate significant pouch pitch changes, such as for example, from three inches to four inches. The convertible pitch knife, however, disclosed in the foregoing incorporated patent application by the same name, does show the details of such a structure. Essentially, such convertible pitch knife which is capable of handling significant pouch pitch changes, such as those which can be accommodated by the foregoing changes in the machine 10 to the sealer and filler wheels, are shown in FIGS. 6, 7 and 8. Such a knife includes a support cage 140 housing a major knife hub drive shaft 141 and a minor knife hub drive shaft 142 supporting in cantilevered fashion a major knife hub 143 and a minor knife hub 144. The major hub includes a plurality of knife blades 145 supported on the hub and the minor hub includes a plurality of minor knife blades 146. The two hubs are driven simultaneously, such that the blades of each respectively intermesh to shear and cut off individual pouches such as pouches P-1 through P-4 from a pouch web train or bandolier 32 (FIG. 1). The cuts are made preferably in the middle of the vertical seals between the respective pouches, such seals having been applied to the pouch web by the sealer 20.

A cantilevered support plate 147 is utilized to support the outer ends of the major and minor hub drives. The major hub 143 is provided with a screw adjustable cone 148 which can be moved laterally by means of a drive screw to adjust the knife blades and/or pouch guides in a radial direction to accommodate minor variations in seal position in the pouch web. Nevertheless, through this adjustment capability, it is insufficient to accommodate significant pouch pitch changes as contemplated herein.

The major knife hub 143 is also provided with a plurality of vacuum ports 151 interconnected with the vacuum cups 152 for holding pouches on the major hub. These ports are alternatively pressurized to help to blow pouches off the knife in a preferred sequence which does not constitute part of this invention. To that end, however, a vacuum reservoir 155 is provided in association with an outer adjustable ring 156 and an inner vacuum shoe 157, with various vacuum ports in the ring 156 and vacuum shoe 157 cooperating with various ports in a rotating disc valve or shoe 158 for applying respective vacuum or pressure to the suction cups 152 through the bores in the knife hub in order to secure or to blow pouches onto or from the knife hub in a desired fashion which, in an of itself, does not constitute part of this invention.

It will be appreciated from FIG. 8 that the major knife hub 143 is secured to a hub adapter 1 61 which extends from the support cage 140, while the minor knife hub 144 is mounted on the minor knife hub shaft 162 extending from the support cage 140. The hub adapter 161 and the shaft 142 provide the respective drives for the major and minor hubs 143, 144. The rotating disc valve 158 is also driven by a separate rotating shoe chain 160, running against idler 159, at a speed sufficient to produce the desired suction and blow off functions of the knife.

Figure 8A:
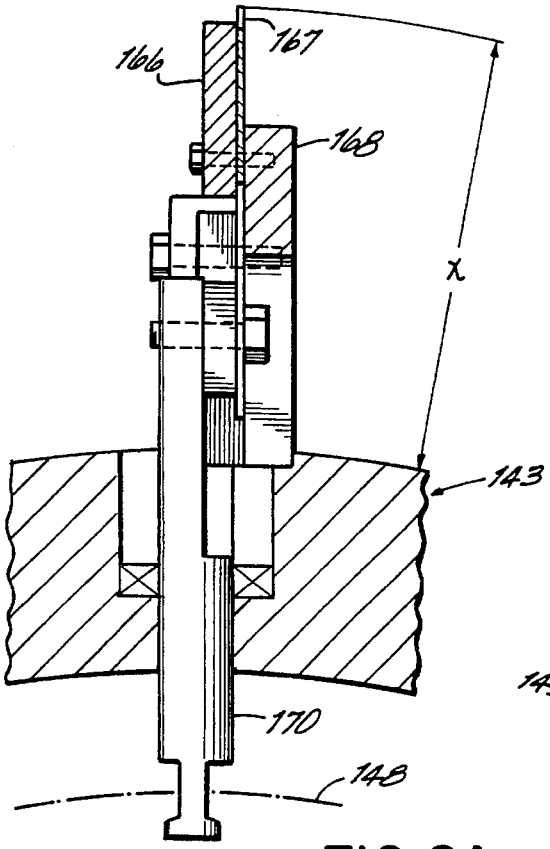
FIG. 8A is a diagrammatic view of portions of one knife for handling one pouch width.
Figure 8B:
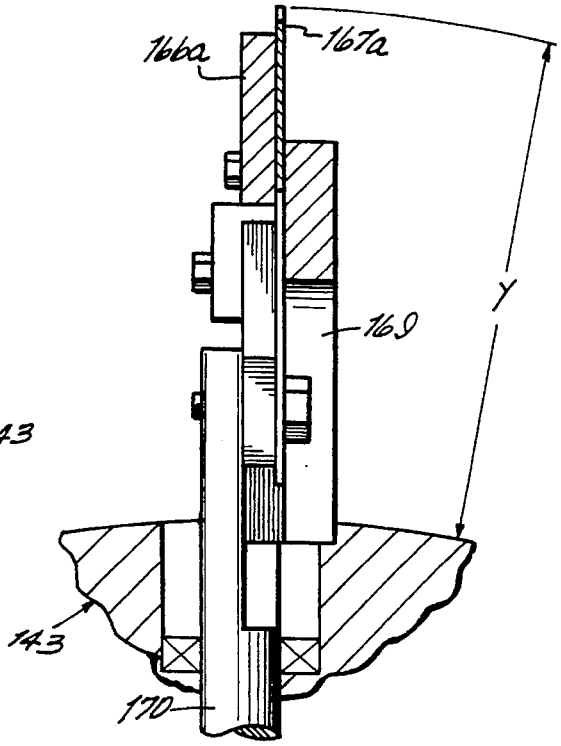
FIG. 8B is a diagrammatic view similar to FIG. 8A but showing portions of a knife conversion to handle a wider pouch width.

It will also be appreciated that the cantilevered support plate 147 is readily removable to provide easy access to the major and minor knife hubs, so that they can be easily removed laterally away from the support cage 140. It will be further appreciated that the knife blades and pouch guides on the major knife hub 143 can be interchanged with other pouch guides and knives to provide substantial radial variations in the positions of the knives and pouch guides to accommodate significantly varying pouch pitches. In this regard, the adjustability features for each knife are retained by means of the adjustable cone 148 as described above, however, various support blocks are utilized in order to provide the desired radial extension of the knife blades and pouch guides to accommodate varying pouch pitches. Thus, as shown in FIG. 8A, a knife 166 and pouch guide 167 are supported on the major hub 143 by means of a knife block 168 for extension of the knife and pouch guide, for example, an approximate distance X from the surface of the major knife hub 143. When conversion is desired, for example, to a wider pouch width, a knife **166*a* and pouch guide 167*a* are mounted on a knife block 169 for positioning the knife 166*a* and the pouch guide 167*a*, a further radial distance Y outwardly from the surface of the major hub 143, as illustrated in FIG. 8B. Fine adjustment from the adjustment cone 148 is still provided by means of the support extensions 170** which are operably attached to the adjustment cone for minor variations in seal position for example. Thus, the adjustment ranges for each of the significantly varying pouch widths are accommodated for all anticipated conversions of the knife for major pouch pitch changes.

In order to convert the knife to handle pouches of a different pitch, the knife is first disassembled (FIG. 8), the cone 148 adjusting hand wheel 171 and the counter 173 is removed from the cantilevered support 147. The rotating shoe chain idler 159 and chain 160 are removed. The web hold down 172 (FIG. 6) is then removed. The vacuum mechanisms, including the various adjustable rings, reservoir and disc valves are then removed. Any retainer ring which has been utilized to hold the minor knife hub on the shaft 142 is removed and the minor knife hub 144 is then removed laterally off the shaft 142. Thereafter, the screws holding the major knife hub 143 on hub adapter 161 are removed and the major knife hub 143 is removed laterally. This generally completes the disassembly of the knife station 36. Reassembly can be conducted in several ways. First, conversion parts such as those shown in FIGS. 8A and 8B can be adapted or changed to the hub, or a new hub already outfitted with the conversion parts can be utilized. At the same time, the minor hub 144 is also changed, its blades now provided in number and in orientation to cooperate with the positions of the knife blades on the major hub 143 to be remounted in the knife 36. The major knife hub assembly is applied to the hub adapter 161 by means of screws thereon. The new minor knife hub 144 is slid onto shaft 142 and secured. The rotating shoe, the inner and outer adjustment rings or shoes 156, 157 are applied to the major knife hub 143 and to the shaft 179, extending from the major knife hub 143. The various vacuum connections are made. The cantilevered support plate 147 is then installed in the vacuum and the web hold down 172 attached to it. The rotating shoe chain 160 and chain idler 159 are installed and tensioned and any 173 counter and handwheel 171 then installed. Adjustments are made as necessary and the knife 36 is thus ready to run to cut pouches of a different pouch pitch than prior to the conversion when the knife was outfitted differently. It will be appreciated that the new hub might be provided with a differing number of blades and pouch guides from a prior hub, and an associated minor knife hub will be provided therewith. Primarily, however, what is contemplated is the conversion of the standardized knife hub by means of the change parts as illustrated in FIGS. 8A and 8B to mount the knife blades substantially inwardly or outwardly of a prior position to accommodate major pouch pitch changes.

Figure 12:
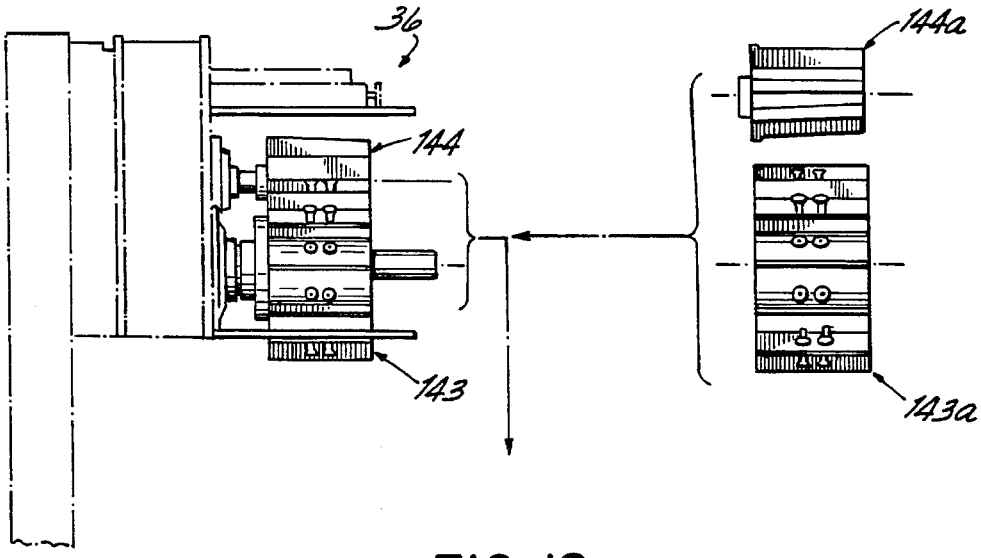
FIG. 12 illustrates a knife conversion according to the invention.

Turning now to FIGS. 9 through 12, there is illustrated in these figures the process steps of the invention. In FIG. 9, the pouch forming and filling machine 10 is shown with removable sealer wheel 20*a* and removable filler wheel 28*a*. The machine 10 is provided with a tabletop 43 and with a frame work or super structure 180 comprising a plurality of frame members for supporting a filler apparatus 45 (not shown) in this figure (see FIG. 1). It will be appreciated that the frame work 180 is provided with an open area 181 for accommodating the lifting and removal of the old filler wheel 28 and the replacement thereof with a new filler wheel such as filler wheel 28*a*, for example. It will be appreciated that the drive axis 40 and the drive axis 42 are fixed in a table top 43 and do not move, even though the sealer 20, 20*a* and filler wheel assembly 28, 28*a*, having differing numbers of pouch stations thereon, are changed. Nevertheless, and as is discussed above, the diameters of the sealer wheel 20, 20*a* and 28, 28*a* are maintained substantially constant. Turning now then to FIG. 10, a first sealer 20 is removed and a second sealer wheel 20*a* is replaced on the drive axis 40. It will be appreciated that the number of pouch stations provided in the wheel 20 are different from those provided in the wheel 20*a*, in order to accommodate different pouch widths or pitch. Likewise, referring to FIG. 11, it will be appreciated that a first filler wheel assembly 28 is removed while a second wheel assembly 28*a* is replaced on the drive axis 42 extending from table top 43. The number of filler stations in wheel 28*a* differ from the number of filler stations or pouch stations in the filler wheel apparatus 28. It will be appreciated that the ratio of the stations in the sealer wheel 20 to the ratio of the pouch stations in the filler wheel 28 is the same as the ratio and the number of pouch stations in sealer 20*a* to the number of pouch stations in the filler wheel 28*a*, and yet the diameters of the sealer wheels 20, 20*a* are maintained relatively constant, while the diameters of the filler wheel 28 and 28*a* are maintained relatively constant. Thus, the delivery position and orientation of the pouch train to the top sealer 30 (FIG. 1) is maintained at a relative constant so that pouch sealing path A is approximately tangent to the operative circumference of both the filler wheels 28 and 28*a*, even though each of those wheels varies in the number of pouch stations thereon. The same drive axes 40 and 42 are used and the sealer 30 is not moved. With reference to FIG. 12, it will be appreciated that the knife represented by the major and minor hubs 144 and 143 are removed from the knife 36 and are replaced by the major and minor hubs 143*a* and 144*a*. Of course, the radial positions of the knives and pouch guides on the hubs 143*a* differ substantially from those on the hub 143 to accommodate the same pouch width variation as are accommodated by the replacement of the filler wheel 28 and sealer wheel 20*a* for the original components as illustrated in FIGS. 10 and 11.

Accordingly, applicant has described a method by which a pouch machine 10 can be converted to handle pouches of significantly varying widths or pitches, all while utilizing a standard drive, such as represented by the drive components in dotted lines beneath the table 43 (FIG. 1) and without relocating any of the major drive axes, such as the sealer drive axis 40 or the filler drive axis 42. This maintains the pouch web train through the machine in a substantially constant orientation. This permits the utilization of the same top sealer without any derogation to the top sealing function, or to the handling of the filled pouch web on path A prior to top sealing.

Moreover, and more importantly, the invention provides methods by which pitch conversions are readily attained in pouch filling machines without the necessity for major machinery rebuilding and down time. With the changeover components as noted herein, a pouch machine can readily be changed over, on-site, within a very short time and at a low cost compared to prior conversions in order to handle varied pouch pitches, so that the machine user can more readily and quickly respond to market changes or other needs for varied size pouches. Moreover, standard drives can be used and inventoried, awaiting order, with appropriate sealer and filler wheels and knives then applied, thus reducing order lead time and costs per unit.

These as well as other advantages and modifications, such as those noted in the foregoing discussions, will become readily apparent to those of ordinary skill in the art without departing from the scope of this invention, and the applicants intend to be bound only by the claims appended hereto.

We claim:

1. A method of converting a pouch filling and sealing machine from one pouch pitch to another, wherein the machine includes a drive, a first vertical sealer wheel having a first number of pouch stations thereabout, a first filler wheel having a second number of pouch stations there about, and a rotatable knife, the method comprising the steps of:

removing the first vertical sealer wheel and the first filler wheel;

installing a second vertical sealer wheel having a diameter substantially the same as that of the removed vertical sealer wheel, and having a number of pouch stations thereabout different from said first number; and installing a second filler wheel having substantially the same diameter as the removed filler wheel and having a number of pouch stations thereabout different from said second number.

2. A method as in claim 1 including the step of changing at least parts of said knife to cut-off pouches at said other pitch.

3. A method as in claim 2 including the step of maintaining the same drive speeds to said installed sealer and filler wheels as to the respective removed wheels.

4. A method as in claim 3 including the step of running said pouch machine and producing pouches of a different pitch at substantially the same web speed as the web speed produced by the machine with the removed wheels.

5. A method as in claim 1 wherein said first filler wheel is mounted on a first fixed drive axis and said first sealer wheel is mounted on a second fixed drive axis, the method including the further steps of mounting said second filler wheel on said first drive axis and said second vertical sealer wheel on said second drive axis.

6. A method as in claim 5 including the step of maintaining the diameter across said second filler wheel approximately the same as the diameter across the first filler wheel.

7. A method of converting a pouch filling and sealing machine from one pouch pitch to another, including the steps of:

removing at least one vertical sealer wheel having a first number of pouch stations and replacing it with another vertical sealer wheel having a second different number of pouch stations and substantially the same diameter;

removing at least one filler wheel having a third number of pouch stations and replacing it with another filler wheel having a fourth different number of pouch stations and substantially the same diameter;

wherein the ratio of the fourth number to the second number is the same as the ratio of the third number to the first number; and providing a knife to cut off pouches at said other pitch.

8. A method as in claim 7 including the further step of running a pouch web about said wheels up to substantially the same maximum web speed as run about the replaced wheels.

9. A method of converting a pouch filling and sealing machine from handling pouches of one pitch at a given maximum web speed to handling pouches of another pitch and at speeds up to said maximum web speed wherein said machine has a standard drive, a vertical sealer, filler wheel, top sealer and a knife for sealing an elongate web, filling pouches formed by said seals, top sealing said web to form individually closed pouches in a train and for cutting said web at said seals to separate pouches one from another, said method comprising:

replacing one sealer wheel having one number of pouch stations with a replacement sealer wheel having another number of pouch stations;

replacing one filler wheel having a number of pouch stations with a replacement filler wheel having another number of pouch stations;

the number of stations on said replacement filler wheel being the same ratio to the number of stations on said replacement sealer wheel as the number of stations on the one filler wheel to those on the one sealer wheel;

replacing components of said knife to cut off pouches of another pitch; and driving said replacement wheels at the same drive speeds as the one replaced wheels were driven to produce filled pouches at the same web speed as the web speed of pouches of said one pitch.

10. A method as in claim 9 wherein said replacing steps include replacing one of said sealer or filler wheels with a wheel having a number of pouch stations positioned at increments on said wheel other than at standard degree increments.

11. A method as in claim 9 wherein said replacing steps include replacing said filler and sealer wheels with wheels having a different number of pouch stations than the respective replaced wheels; and the same ratio of pouch stations, as the replaced wheels, to one another.

12. A method of converting a pouch filling and sealing machine from handling pouches of one pitch running up to a maximum predetermined web speed, to handling pouches of another pitch wherein the machine includes a vertical sealer wheel and a filler wheel, each having a number of pouch stations thereabout, including the steps of:

replacing said wheels with respective other wheels having respectively substantially the same respective diameters and different numbers of pouch stations thereon; and running said other wheels to produce pouches of a different pitch at speeds up to said maximum predetermined web speed.

13. The method of claim 12 further including the step of replacing the filler wheel with another filler wheel with a circumference tangent to a path of open-ended pouches through a pouch top sealer.

14. The method of claim 12 wherein the step of replacing said wheels includes operably mounting said other wheels on the same drive axes as the respective replaced wheels.

15. In a method of converting a pouch filling and sealing machine from handling pouches of one pitch to handling pouches of another pitch, wherein said machine has a first pouch filler wheel rotatable about a fixed drive axis and provided with a first number of pouch filling stations and aligned with a top sealer such that a portion of the circumference of the filler wheel from which filled pouches are discharged is approximately tangent to a linear pouch sealing path through said sealer the method including the steps of:

removing said first filler wheel from said machine;

mounting a second filler wheel on said machine for rotation about said axis, said second filler wheel having a second number of pouch filling stations thereon, different from said first number; and said mounting step including orienting a portion of the circumference of the second filler wheel from which filled pouches are discharged approximately tangent to said linear pouch sealing path while maintaining said second filler wheel rotation about said axis.

16. In the method of claim 15 wherein the machine also includes a first vertical sealer wheel mounted on said machine for rotation about a second fixed drive axis, and having a third number of pouch sealing stations thereon, said method including the additional steps of:

removing said first vertical sealer wheel;

replacing said first vertical sealer wheel with a second vertical sealer wheel having a fourth number of pouch sealing stations thereon, including mounting said second vertical sealer wheel for rotation about said second fixed drive axis;

wherein said fourth number of stations on said second sealer wheel bears the same ratio to said second number of stations on said second filler wheel, as said third number of stations on said first sealer wheel bears to said first number of stations on said first filler wheel.

17. A method as in claim 16 including the step of maintaining said ratio at about 2:3.

18. A method as in claim 17 including the step of maintaining the diameter of said second sealer wheel between sealing lands across the wheel at approximately the same diameter as that between the sealing lands across the first sealer wheel.

19. A method as claim 18 including the step of locating said station on at least one filler wheel at other than whole degree increments about said wheel.

* * * * *